United States Patent [19]

Kewin

[11] 4,166,433

[45] Sep. 4, 1979

[54] TUYERES WITH INDEPENDENT COOLING CIRCUITS FOR NOSE AND BODY PORTIONS

[75] Inventor: James N. Kewin, Workington, England

[73] Assignee: British Steel Corporation, London, England

[21] Appl. No.: 851,376

[22] Filed: Nov. 14, 1977

[30] Foreign Application Priority Data

Nov. 25, 1976 [GB] United Kingdom ..... 49247/76

[51] Int. Cl.[2] ..... F22B 37/00; F23L 1/00

[52] U.S. Cl. ..... 122/6.6; 110/182.5; 266/265

[58] Field of Search ..... 266/265, 266; 110/182.5; 122/6.6

[56] References Cited

U.S. PATENT DOCUMENTS

| | | | |
|---|---|---|---|
| 2,891,783 | 6/1959 | Eberhardt | 110/182.5 |
| 3,840,219 | 10/1974 | Sheridan et al. | 122/6.6 |
| 3,926,417 | 12/1975 | Horio et al. | 122/6.6 |

*Primary Examiner*—Kenneth W. Sprague

*Attorney, Agent, or Firm*—Bacon & Thomas

[57] ABSTRACT

A cast tuyere has two independent cooling circuits for the nose and the body portions, respectively. The nose channel for the coolant having been formed by a removable frangible core around which the nose portion has been cast. The nose channel preferably additionally includes a rod extending centrally through it so as to define an annular passage for the cooling water.

12 Claims, 6 Drawing Figures

FIG. 1.
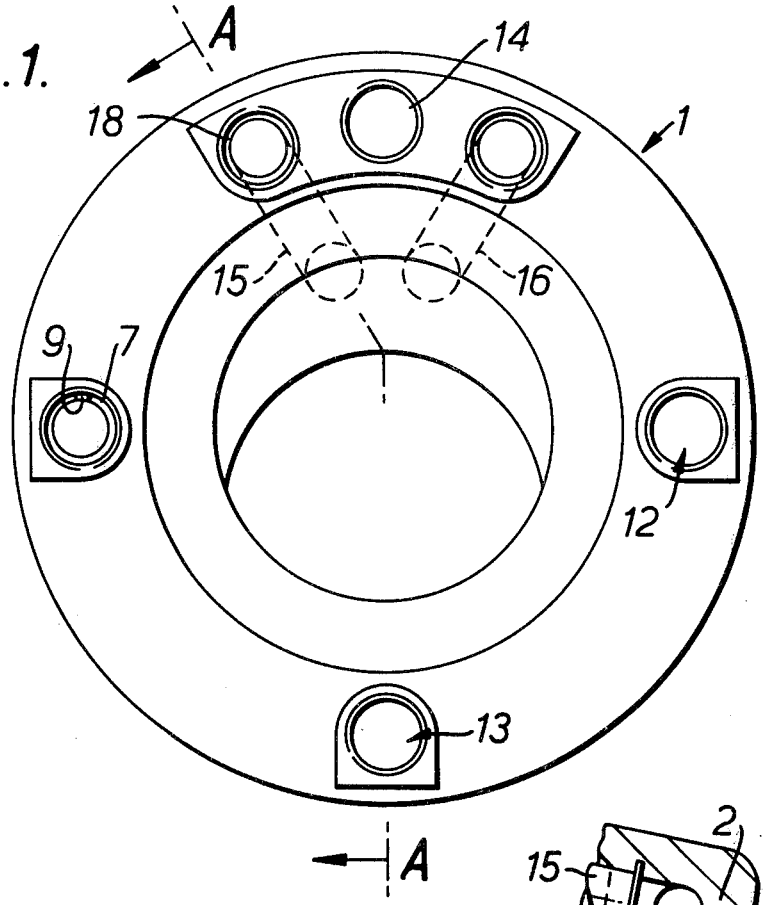
FIG. 4.
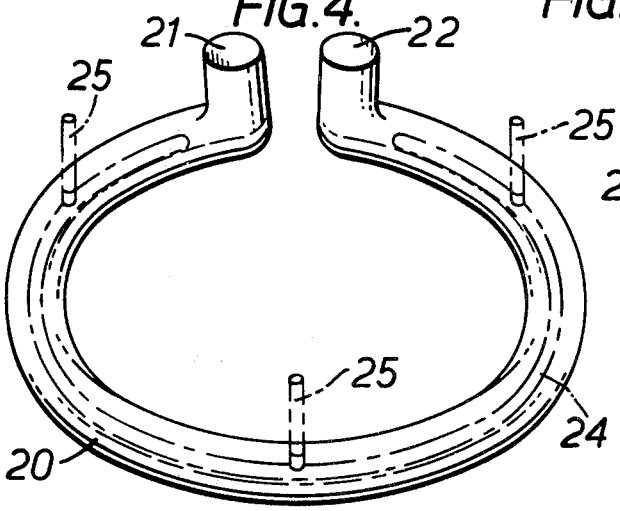
FIG. 5.
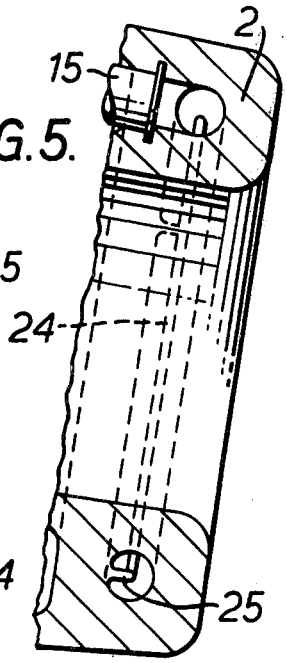
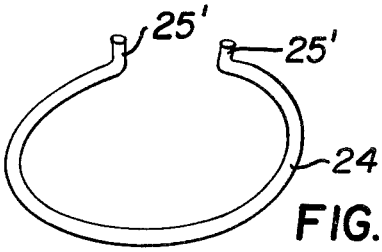
FIG. 6.

TUYERES WITH INDEPENDENT COOLING CIRCUITS FOR NOSE AND BODY PORTIONS

BACKGROUND OF THE INVENTION

This invention relates to tuyeres and more particularly relates to tuyeres having separate body and nose chambers whereby the latter is preferentially cooled.

Preferential cooling for the nose area of tuyeres in, for example, blast furnaces has for some years now been accepted as a pre-requisite for good preformance and long life in service. Such cooling is established by conducting the coolant directly to the nose chamber through a tube which extends through the rear (body) chamber and the coolant issues from the nose either via the rear chamber—in which case there is only one inlet and one outlet necessary—or through another tube which passes through the rear chamber in a like manner to the inlet—in which case the rear chamber is separately supplied with coolant necessitating two inlets and two outlets for the tuyere.

The latter design therefore embodies two independent liquid coolant circuits and where the external pipework permits of this design it is preferred.

Two methods of construction of tuyeres having separate body and nose chambers have primarily been used. In one a bent tube extends through the rear chamber and itself constitutes the nse chamber within the mass of copper (or other good conductivity material) which is cast around it; in the other a separate nose chamber is prefabricated and joined on to the main body section; e.g. by welding or brazing, this chamber being coupled into circuit by an inlet tube, or an inlet and an outlet tube (as appropriate), which extends through the rear chamber as before.

Tuyeres provided by either of these methods however have inherent problems detrimental to performance in service. With the cast-in tube there is difficulty in ensuring an adequate bond between the tube and the surrounding cast metal; voids are often produced in this region which adversely affect the heat transfer characteristics. With a pre-fabricated nose chamber doubts arise in the ability of welded or brazed joints to withstand the harsh operating conditions within the furnace and failures giving rise to leakage of coolant (water) are not unknown.

It is an object of this invention to provide an improved tuyere.

SUMMARY OF THE INVENTION

From one aspect the present invention provides a cast tuyere comprising an annular body having a hollow rear chamber and a nose portion within which a channel is defined, and coolant inlets and outlets for the rear chamber and the nose channel, the inlet for the nose channel comprising a tube extending through the rear chamber and communicating with one end of the channel, the channel having a section compatible with that of the communicating tube whereby to provide a smooth coolant flow path through the nose and having been formed by a removable frangible core around which the nose portion has been cast.

The inlet to the rear chamber may be constituted by the outlet from the nose channel—the core from which the nose channel has been cast simply extending from the core from which the rear chamber has been formed—or alternatively the outlet for the nose channel may comprise another tube communicating with the other end of the channel and extending back through the rear chamber. In this case the rear chamber would be provided with its own coolant inlet and outlet so that it constitutes a separate and independent coolant circuit from the nose channel, and the inlet to this chamber may comprise a further tube which terminates adjacent the nose in a lateral aperture.

From another aspect therefore, the invention provides a cast tuyere comprising an annular body having a hollow rear chamber and a nose portion within which a channel is defined, and independent cooling circuits including an inlet and an outlet for each of the rear chamber and nose portions, respectively, the rear chamber inlet comprising a tube extending into the chamber from the rear end thereof and terminating adjacent the nose in a lateral aperture and the inlet and outlet for the nose comprising tubes which extend through the rear chamber and communicate with opposite ends of the nose channel, the channel having a section compatible with that of the communicating tubes whereby to provide a smooth flow path through the tuyere and having been formed by a removable frangible core around which the nose portion has been cast.

The tubes and the nose channel may be circular in cross-section, although alternatively they may be elliptical and the nose tubes may conveniently be secured in the tuyere body, at their ends, by metal cast around them. Preferably, however, the section of the nose channel is modified, the core being built around a central rod having its end either secured to the tubes or cast-in with the parent metal—the channel then defining an annular section through which the coolant flows. In this way either the velocity of the coolant is increased through the channel (where the cross-sectional area is smaller than that of the inlet tube) or if the channel area is increased to match that of the tube to maintain uniform velocity, then a much greater surface area is available for heat exchange. Either way heat exchange efficiency is increased.

In accordance with this invention therefore a cast tuyere is provided which avoids the problem outlined above both in respect of weld failure etc. and inadequate bonding between an inlet pipe and the parent metal, the only bond of this nature being over a small area at the tube ends where the efficiency of heat extraction is not affected. A further improvement in efficiency is realised by the rod in the nose channel as described.

BRIEF DESCRIPTION OF THE DRAWINGS

In order that the invention may be fully understood, two embodiments thereof each providing two independent cooling circuits will now be described, by way of example, with reference to the accompanying drawings, in which:

FIG. 1 is a plan view of the tuyere;

FIG. 4 is a detail of the nose core ring which is utilized to define a nose channel, showing the central rod as an alternative;

FIG. 5 is a sectional detail of the tuyere nose with the rod in situ; and

FIG. 6 is an alternate embodiment of the instant invention wherein the central rod is supported at the ends thereof.

DETAILED DESCRIPTION

Figure 2:
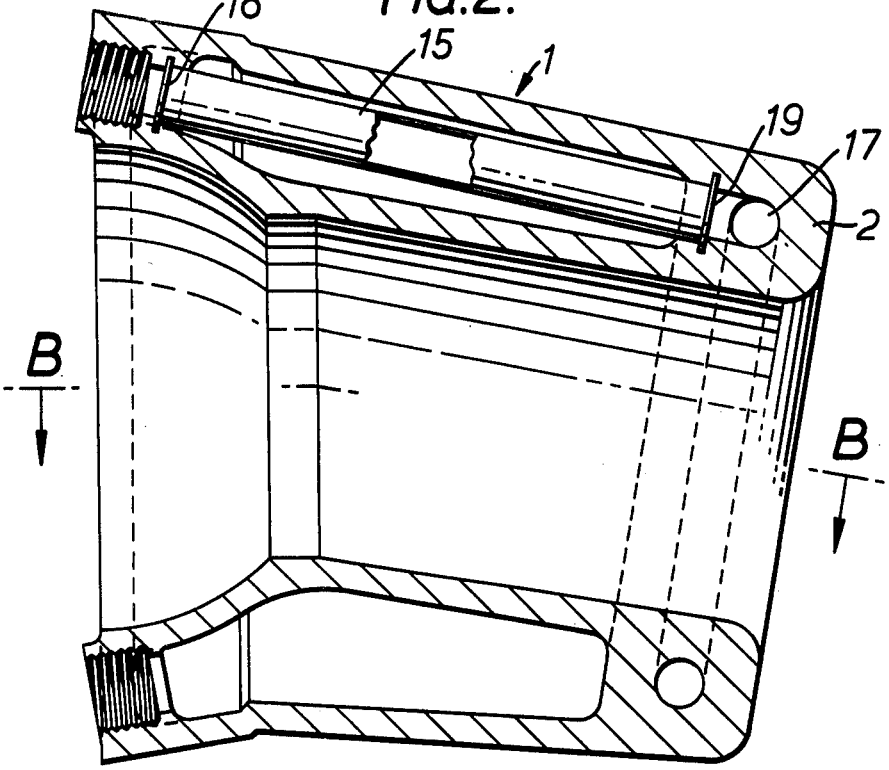
FIG. 2 is a section along A—A in FIG. 1.
Figure 3:
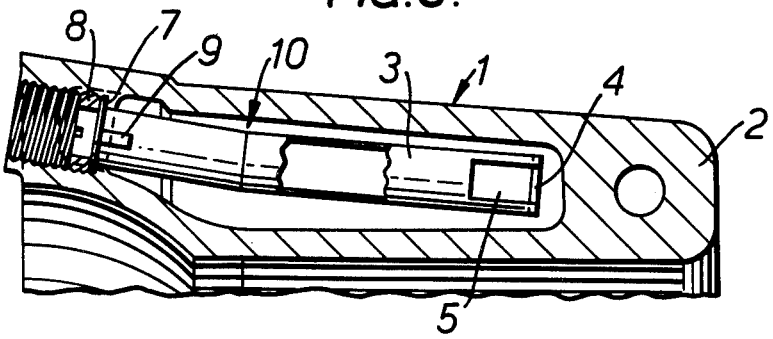
FIG. 3 is a section along B—B in FIG. 2.

Referring now to FIGS. 1 to 3, the tuyere comprises a high purity copper casting having a hollow section body portion 1 and a nose portion 2, the whole defining a central aperture through which, in operation, a gas, e.g. air, is blasted through a blow pipe (not shown) accommodated in the rear of the tuyere.

A copper tube 3 extends into the rear chamber formed in the body portion, this tube being sealed with a disc 4 at its inner end and having an aperture 5 in its side. At its outer end the tube is flanged at 7 and is held in position by a nut 8 which abuts this flange, the orientation of the tube being established by a key 9 which ensures that the tube lies correctly in place as regards the bend (10) and that the aperture 5 faces laterally within the chamber.

A threaded outlet aperture for the rear chamber is provided at 12, this being substantially the same as two other threaded apertures 13, 14 which are utilised for core retention during casting and are subsequently plugged. Copper inlet and outlet tubes 15, 16 extend inwardly at an angle to one another to communicate with a channel 17 formed around the nose portion 2. Unlike the tube for the rear chamber, these two tubes 15, 16 are cast into place within the parent metal, flanges 18, 19 being provided at each end of the two tubes to provide a 'key' for this purpose.

The channel 17 is formed by a core ring around which the metal is cast in much the same way as the rear chamber in the body portion. In particular, the core ring 20 (FIG. 4) is made of a removable franqible material and is substantially torroidal in form but has two upstanding pillars 21, 22 at its ends which extend into and are secured in the inner ends of the tubes 15, 16 respectively, whereby the ring is held in position during casting. When the ring is removed an arcuate nose channel is formed defining the greater part of a toroid which has an inlet at one end and an outlet at the other end that are aligned with or are coextensive with the tubes 15 and 16 to form a smooth flow path so as to avoid dead spots and turbulence which could adversely affect the heat transfer characteristics of the tuyere.

Reference will later be made to the copper rod and tie-bars shown dotted in this Figure.

In preparing the mould for the tuyere casting therefore, a sand mould part is initially formed around a pattern defining the whole of the exterior surface of the tuyere body and nose (excepting the blow pipe cavity). The pattern is removed and an annular core is then inserted incorporating the two tubes 15, 16 from the bottom of which the nose core ring 20 depends. The blow pipe core is then located in position and after preparation of the core retention fittings and vent-holes etc. in accordance with normal foundry practice, high purity copper is cast into the cavities formed.

Furane sand is preferably used for the mould and cores, since this readily breaks down after solidification of the copper, becoming free flowing and easily removable, which is particularly important for the nose core ring where a smooth clean surface is a necessity.

In operation therefore the water coolant follows two independent paths through the tuyeres, through the nose in an uninterrupted path via tube 15, channel 17 and tube 16 and through the rear body cavity via tube 3, the lateral outflow from the aperture 5 adjacent the nose promoting a spiral flow path through this chamber before issuance through the aperture 12.

Referring now again to FIG. 4 is shown in dotted outline a ring-shaped copper rod 24 together with three upstanding copper tie-bars 25. This is an alternative form of construction by which the efficiency of cooling in the nose portion is increased. With this arrangement the core ring 20 is supported as before but in addition the tie-bars protrude upwardly towards the annular core defining the rear chamber. During casting these bars fuse with the cast copper so that upon removal of the core the rod 24 is held in situ by the bars 25.

The final constructional form is shown in FIG. 5 where it can be seen that the rod 24 extends centrally around the nose chamber supported by the bars 25.

With this arrangement then, the water coolant flows along a path of annular section the velocity therefore being increased significantly over this area (since it is smaller in section than the inlet tube 15) resulting in a greater efficiency in cooling.

A tuyere in accordance with this invention therefore possesses all the advantageous attributes of the previous designs referred to but additionally provides improved heat exchange efficiency in the nose as compared with cast tuyeres hitherto since (i) the coolant water is in direct contact with the parent cast metal and follows a substantially uninterrupted flow path throughout and (ii) the velocity of the coolant is increased in the nose (or the surface area available for cooling is greater). Furthermore, the safety factor in the event of nose failure is an improvement on those previous designs which incorporated a cast-in nose tube because difficulties are frequently encountered in effecting an adequate bond between the tube and the parent metal, and hydraulic pressure testing cannot identify any such inadequacy.

Although the invention has been described with reference to the specific embodiment illustrated, it will be understood that various modifications may be made without departing from the scope of this invention. For example, the tie-bars supporting the copper rod could be of a more streamlined planar shape instead of circular so as to minimise the water flow path and they could be staggered somewhat instead of being in line. The rod may alternatively be supported by spiders on end mountings adjacent the inlet and outlet tubes 15, 16 - either in the tubes themselves or the cast metal adjacent them - or the two ends of the rod could simply be 'bent' into the parent cast body as illustrated by the ends 25' of FIG. 6 which are bent out of the path of the arcuate portion 24 of the rod so as to be fused with the parent cast body.

As a further modification the inlet tube 15 can simply be bent at its inner end to provide for lateral issuance of the coolant, instead of fabricating the tube, as shown, for this purpose.

As earlier discussed the principles of this invention can also be used in tuyeres in which the nose circuit coolant issues into the rear chamber. This form of tuyere thus embodies a single inlet and a single outlet which suits the exterior pipework existing in many furnace installations, although provision may also be made for the rear chamber to have another, separate, inlet as well.

The central rod in the nose could also be embodied in the previously identified designs of the separate nose tube cast in situ or in the separate pre-fabricated forged nose chamber which is then brazed or welded on to the body section.

We claim:

1. A cast tuyere comprising: an angular body having a hollow rear chamber and a nose portion; said nose portion having an arcuate nose channel therein having been formed by a removible frangible core around which the nose portion has been cast and defining a greater part of a toroid which has a cast inlet at one end and a cast outlet at the other end; coolant inlets and outlets for both the rear chamber and the nose channel; the coolant inlet for the nose channel including an inlet tube extending through the rear chamber for connecting with the cast inlet at said one end of the nose channel, which cast inlet is coextensive with the inlet tube to thereby provide a smooth coolant flow path through the nose channel.

2. A cast tuyere according to claim 1, further comprising a rod extending centrally through the nose channel whereby the channel defines a flow path for the coolant which is annular in cross section.

3. A cast tuyere according to claim 1, wherein the coolant inlet for the rear chamber includes an additional tube which terminates adjacent to the nose portion and has a lateral aperture adjacent to the nose portion opening to the rear chamber.

4. A cast tuyere according to claim 3, wherein the outlet for the nose channel includes an outlet tube extending through the rear chamber and communicating with the cast outlet at said other end of the nose channel.

5. A cast tuyere comprising: an annular body having a hollow rear chamber and a nose portion defining a nose channel therethrough; independent cooling circuits including an inlet and an outlet for both the rear chamber and nose channel, the rear chamber inlet comprising a tube extending into the chamber from the rear end thereof and terminating adjacent to the nose portion with a lateral aperture opening adjacent to the nose portion, and the inlet and outlet for the nose channel comprising tubes which extend through the rear chamber and communicate with opposite ends of the nose channel; said nose channel having sections compatible with that of the communicating tubes to thereby provide a smooth flow path through the tuyere and having been formed by a removable frangible core around which the nose portion has been cast.

6. A tuyere according to claim 5, in which the inlet and outlet tubes for the nose channel are secured within the tuyere body by being integrally cast with the tuyere body.

7. A tuyere according to claim 6 further including a rod extending centrally through the nose channel whereby the channel defines a flow path of annular cross-section for the coolant.

8. A tuyere according to claim 7, including means for securing the rod at its ends with the rod disposed adjacent to the inlet and outlet tubes for the nose channel.

9. A tuyere according to claim 7, including means for securing the rod intermediate the ends thereof wherein the means are integrally cast with the tuyere body.

10. A tuyere according to claim 5, in which each said tube and the nose channel are circular in cross-section.

11. A cast tuyere comprising: an annular body having a hollow rear chamber and a nose portion; said nose portion having an arcuate nose channel cast therein, said nose channel defining a greater part of a toroid and having a cast inlet projecting from one end toward the hollow rear chamber and a cast outlet projecting from the other end toward the hollow rear chamber; coolant inlets and outlets for both the rear chamber and nose channel; the coolant inlet and outlet for the nose channel including inlet and outlet tubes made of metal separate from the cast metal, extending through the rear chamber and aligned with the cast inlet and cast outlet, respectively, so as to be coextensive therewith and to thereby provide a smooth coolant flow path through the nose channel.

12. A cast tuyere according to claim 11 further comprising a rod extending centrally through and coextensive with the nose channel to define a flow path through the channel which is annular in cross section.

* * * * *